US007406922B2

(12) United States Patent
Gregory

(10) Patent No.: US 7,406,922 B2
(45) Date of Patent: Aug. 5, 2008

(54) SPOILER ANCHORING SAIL

(76) Inventor: Jess Gregory, 633 Arlington Ave., Westfield, NJ (US) 07090-2105

( * ) Notice: Subject to any disclaimer, the term of this patent is extended or adjusted under 35 U.S.C. 154(b) by 32 days.

(21) Appl. No.: 11/499,562

(22) Filed: Aug. 4, 2006

(65) Prior Publication Data

US 2008/0029008 A1 Feb. 7, 2008

(51) Int. Cl.
*B63H 9/04* (2006.01)

(52) U.S. Cl. ..... 114/102.1; 114/102.29

(58) Field of Classification Search ..... 114/102.1
See application file for complete search history.

(56) References Cited

U.S. PATENT DOCUMENTS 4,512,276 A * 4/1985 Hamann ..... 114/102.12
5,076,186 A * 12/1991 Girard ..... 114/39.29

* cited by examiner

*Primary Examiner*—Jesús D Sotelo
(74) *Attorney, Agent, or Firm*—Lerner, David, Littenberg, Krumholz & Mentlik, LLP

(57) ABSTRACT

Disclosed is a spoiler anchoring sail that counters the swinging and jerking of a sailboat during anchoring or mooring, thereby providing a convenient, comfortable and secure environment to sailors. The anchoring sail comprises a first wing, a second wing attached to the first wing at a common edge, and a spoiler attached to the first wing and the second wing at the common edge. The spoiler, the first wing and second wing are oriented in a manner, such that, an angle between the spoiler and first wing and an angle between the spoiler and second wing is greater than or equal to about an angle between the first wing and second wing. The first wing and the second wing cause dihedral effect and the spoiler is capable of cutting off wind to one side of the anchoring sail, while channeling the wind to other side of the anchoring sail.

22 Claims, 4 Drawing Sheets

SPOILER ANCHORING SAIL

FIELD OF THE INVENTION

The present invention relates to a spoiler anchoring sail that minimizes the swinging and jerking of a sailboat when anchored or on a mooring.

BACKGROUND OF THE INVENTION

In coastal areas, sailboats are often anchored or moored. Wind can cause the tethered sailboats to swing a lot about the anchor line. This is because the center of effort above the water line is forward of the center of resistance below the water line, causing the sailboat to be unstable. It is preferable if the sailboat should stay pointed into the wind in a stable manner without swinging with large amplitude. The swinging can cause many problems. In bad weather with heavier wind loads such swinging causes sailboats to hit against each other, thereby causing serious damage to property and threatening the safety of those aboard the sailboats. The swinging and jerking can cause the anchor to dislodge. And the uncontrolled swinging is a source of discomfort to those aboard the boat. To reduce swinging, boaters use an anchor riding sail or anchoring sail, in the form of a small flat triangular sail that is attached to the back of the sailboat, along the centerline, acting as a wind vane to reduce swinging. These sails often must be fabricated on a custom basis due to the many rigging options inherent in sailboats. Apart from these sails some other mechanisms are also used to avoid the swinging of sailboats. Such sails and mechanisms thereof are not efficient enough to maximize the reduction of the swinging of an anchored sailboat.

Accordingly, there remains a need for a sail or mechanism that can maximize the reduction of swinging of a sailboat in an anchored or tethered position, in an efficient and inexpensive manner.

SUMMARY OF THE INVENTION

In view of the foregoing disadvantages inherent in the prior art, the general purpose of the present invention is to provide a spoiler anchoring sail configured to include all the advantages of the prior art, and to overcome the drawbacks inherent therein.

In an aspect, the present invention provides a spoiler anchoring sail comprising: a first wing, a second wing attached to the first wing at a common edge, and a spoiler attached to the first wing and the second wing at the common edge. The spoiler, the first wing and the second wing are oriented in a manner such that an angle between the spoiler and the first wing and an angle between the spoiler and the second wing are greater than or equal to about an angle between the first wing and the second wing. The spoiler anchoring sail rigged onto a sailboat counters the swinging of the sailboat in an anchored position.

In another aspect, the present invention provides a dihedral anchoring sail, comprising a first wing; a second wing attached to the first wing at a common edge; a spoiler attached to the first wing and the second wing at the common edge; and a plurality of holes and grommets disposed at bottom end portions of the spoiler, the first wing and the second wing, and a top end and a bottom end portion of the common edge, the holes and grommets being capable of removably engaging with fastening means for rigging the dihedral anchoring sail on a sailboat. The spoiler, the first wing and the second wing are oriented in a manner such that an angle between the spoiler and the first wing and an angle between the spoiler and the second wing are greater than or equal to about an angle between the first wing and the second wing. The spoiler, the first wing and the second wing causes a dihedral effect for enabling one wing among the first wing and the second wing to offer more resistance than the other wing. The spoiler is capable of cutting off wind to one side of the anchoring sail, while channeling the wind to the other side of the anchoring sail, thereby developing a strong force vector on a windward side of the sailboat, and an equal reduction in force on a leeward (downwind) side of the sailboat. Due to the action of the spoiler, a powerful correcting effect takes place within the first few degrees of the swing, before the sailboat's swinging momentum has developed. As a result, the action of the spoiler counters the swinging of the sailboat in an anchored or moored position with great efficiency.

In yet another aspect, the present invention provides a method of countering swinging of a sailboat in an anchored position using an anchoring sail. The method comprises pivoting a first wing of the anchoring sail to a first position on a railing disposed on a deck of the sailboat; pivoting a second wing of the anchoring sail to a second position on the railing, the second wing being attached to the first wing at a common edge; pivoting a spoiler of the anchoring sail to an intermediate position on a mast of the sailboat, the spoiler being attached to the first wing and the second wing at the common edge; and pivoting a top end portion of the common edge to a top of the mast. The spoiler, the first wing and the second wing are oriented in a manner such that an angle between the spoiler and the first wing and an angle between the spoiler and the second wing may be altered by changing the positions of lines leading to the deck of the sailboat to create the most effective ratio of drag and sideways resistance for the conditions. The spoiler, the first wing and the second wing causes a dihedral effect for enabling one wing among the first wing and the second wing to offer more resistance than the other wing. The spoiler is capable of cutting off wind to one side of the anchoring sail, while channeling the wind to the other side of the anchoring sail, thereby developing a strong force vector on a windward side of the sailboat, and an equal reduction in force on a leeward (downwind) side of the sailboat. Due to this action of the spoiler, a powerful correcting effect takes place within the first few degrees of the swing, before the sailboat's swinging momentum has developed. As a result, the action of the spoiler counters the swinging of the sailboat in an anchored or moored position with great efficiency.

These together with other aspects of the present invention, along with the various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there are illustrated exemplary embodiments of the present invention.

BRIEF DESCRIPTION OF THE DRAWINGS

The advantages and features of the present invention will become better understood with reference to the following more detailed description and claims taken in conjunction with the accompanying drawings, wherein like elements are identified with like symbols, and in which:

Like reference numerals refer to like parts throughout the description of several views of the drawings.

DETAILED DESCRIPTION OF THE INVENTION

Figure 1:
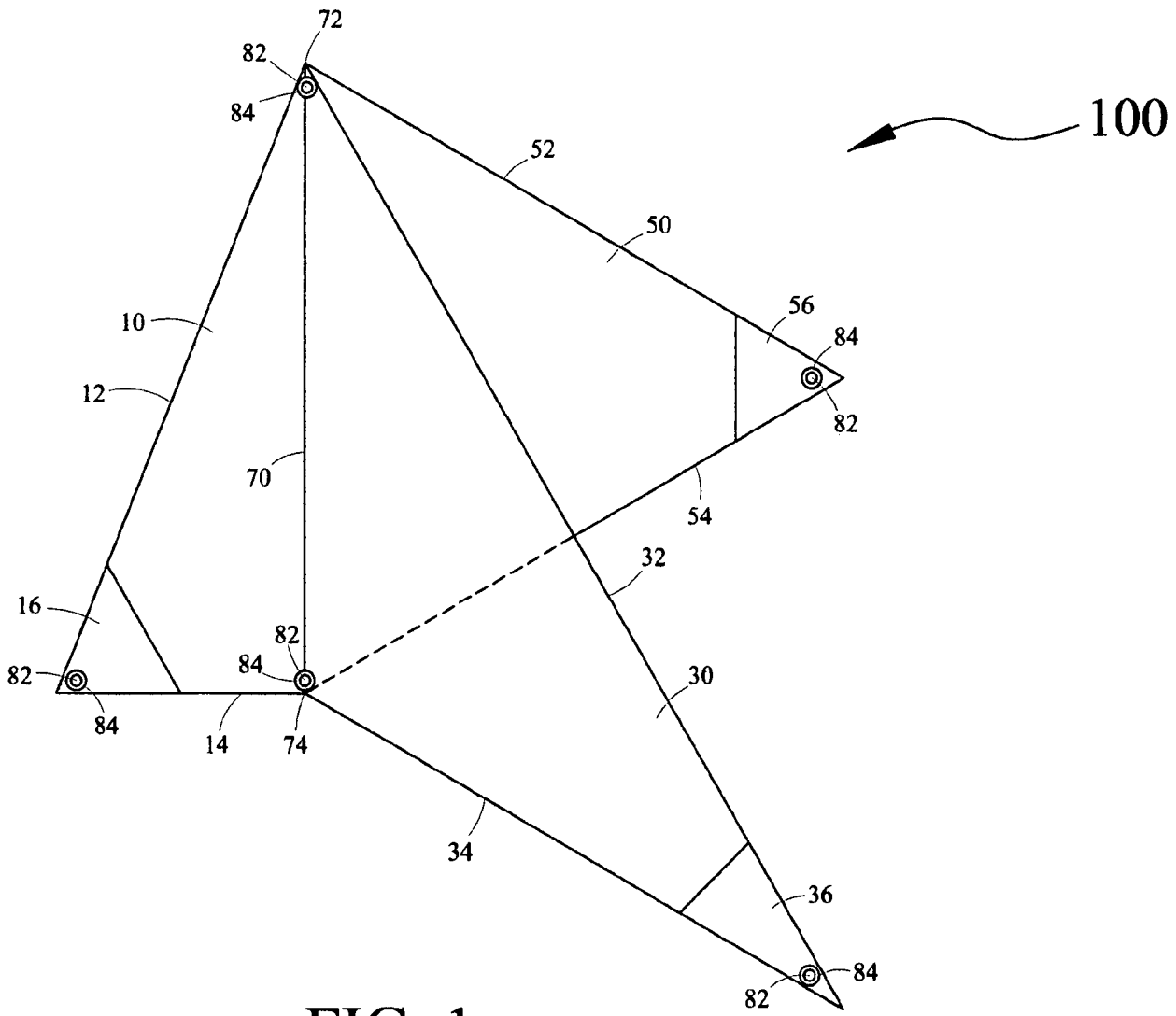
FIG. 1 is a perspective view of an anchoring sail 100, according to an exemplary embodiment of the present invention.

The exemplary embodiments described herein in detail for illustrative purposes are subject to many variations in structure and design. It should be emphasized, however, that the present invention is not limited to a particular anchoring sail, as shown and described. It is understood that various omissions, substitutions or equivalents are contemplated as circumstances may suggest or render expedient, but are intended to cover the application or implementation without departing from the spirit or scope of the claims of the present invention.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

The present invention provides a spoiler anchoring sail that counters the swinging and jerking of a sailboat during anchoring or mooring, thereby providing a convenient and comfortable environment to sailors who go to sea for fun or profession. In deep sea, when combined with an anchoring drogue, using the spoiler anchoring sail to keep the bow pointed ahead, sailors may avoid the dangerous situation created by tacking and jerking which can cause a capsize due to waves hitting the sailboat from the side. Also, the spoiler anchoring sail is capable of reducing the chafing of the anchor line. The spoiler anchoring sail is easy to handle and may be mass-produced in a cost-effective manner in different dimensions according to the dimensions of different sailboats. For purpose of description, the 'spoiler anchoring sail' is referred to as 'anchoring sail'.

Referring to FIGS. 1-4, an anchoring sail 100, is shown. The anchoring sail 100 comprises a spoiler 10, a first wing 30 and a second wing 50. The second wing 50 is attached to the first wing 30 at a common edge 70. The spoiler 10 is attached to the first wing 30 and the second wing 50 at the common edge 70, the spoiler 10 extending from the common edge 70 in a direction away from the direction of extension of the first wing 30 and the second wing 50, thereby constituting an angle B between the spoiler 10 and the first wing 30 and an angle C between the spoiler 10 and the second wing 50 greater than or equal to about an angle A between the first wing 30 and the second wing 50 [See FIG. 3]. The spoiler 10, the first wing 30, and the second wing 50 have a triangular geometry with the three edges, namely, the common edge 70, upper edges 12, 32, 52 respectively, and lower edges 14, 34, 54 respectively. The upper edges 12, 32, 52 converge at a top end portion 72 of the common edge 70; and the lower edges 14, 34, 54 converge at a bottom end portion 74 of the common edge 70.

Figure 2:
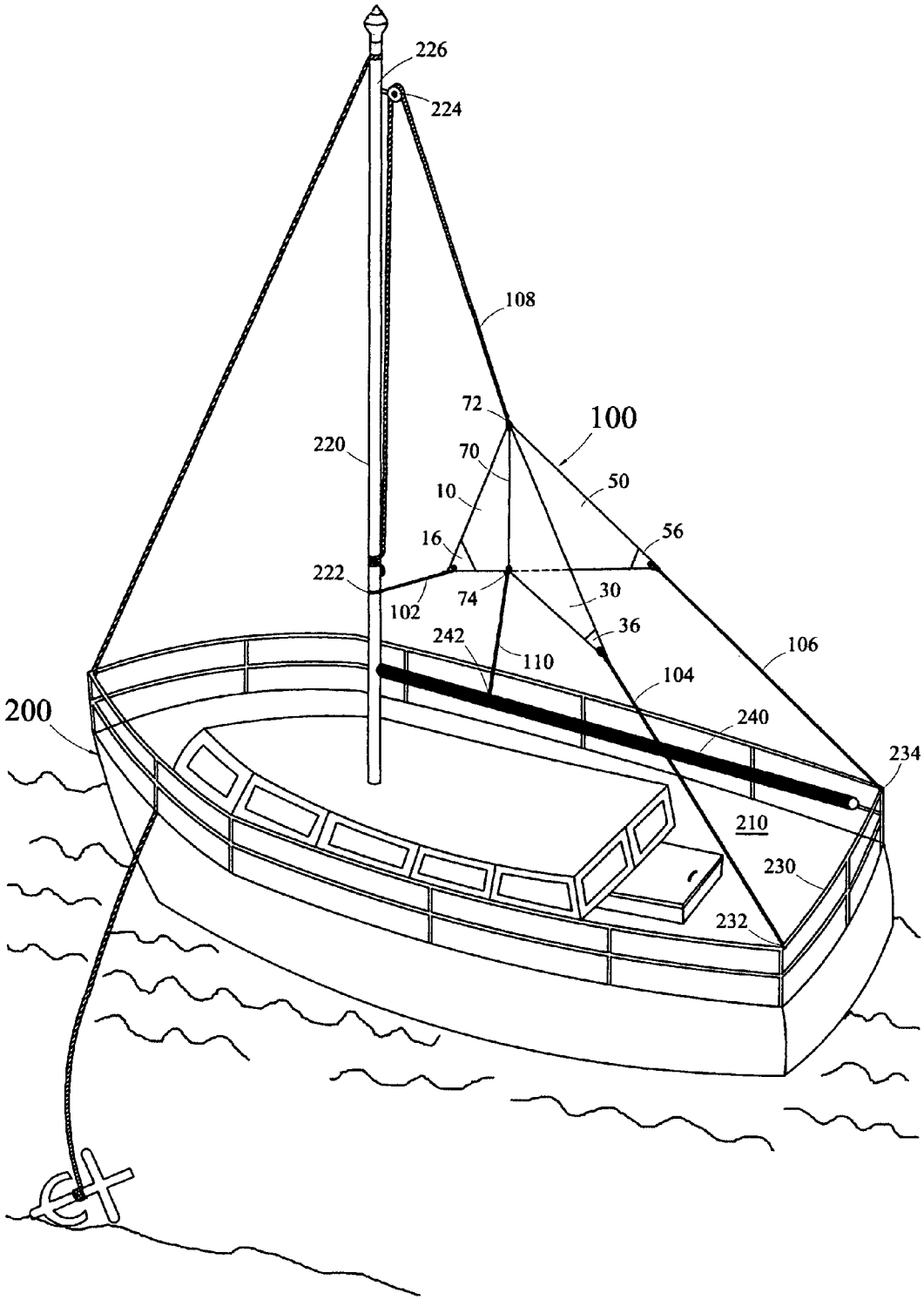
FIG. 2 is a perspective view of a sailboat 200 rigged with the anchoring sail 100, according to an exemplary embodiment of the present invention.
Figure 3:
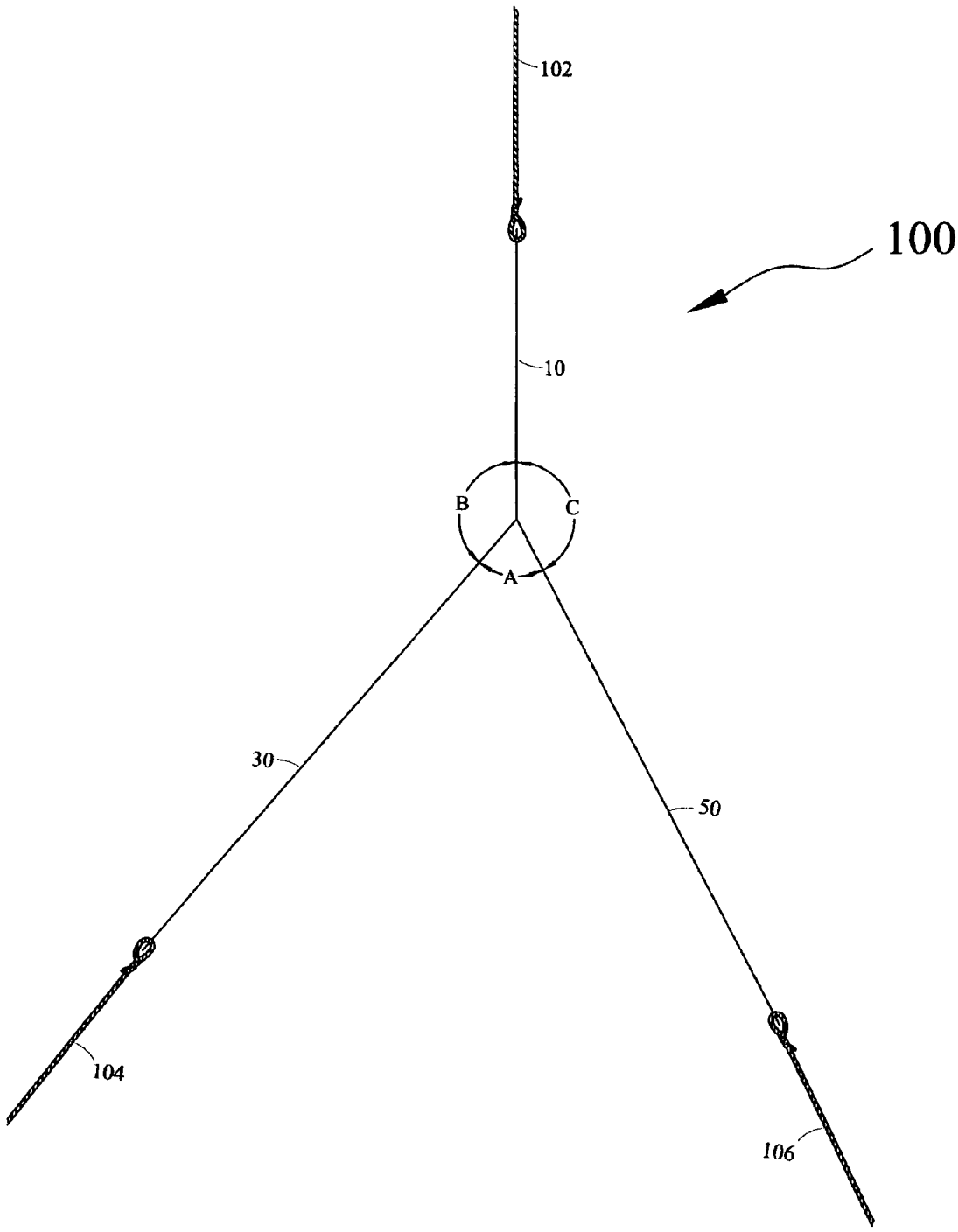
FIG. 3 is a top view of the anchoring sail 100 in the rigged state, according to an exemplary embodiment of the present invention.
Figure 4B:
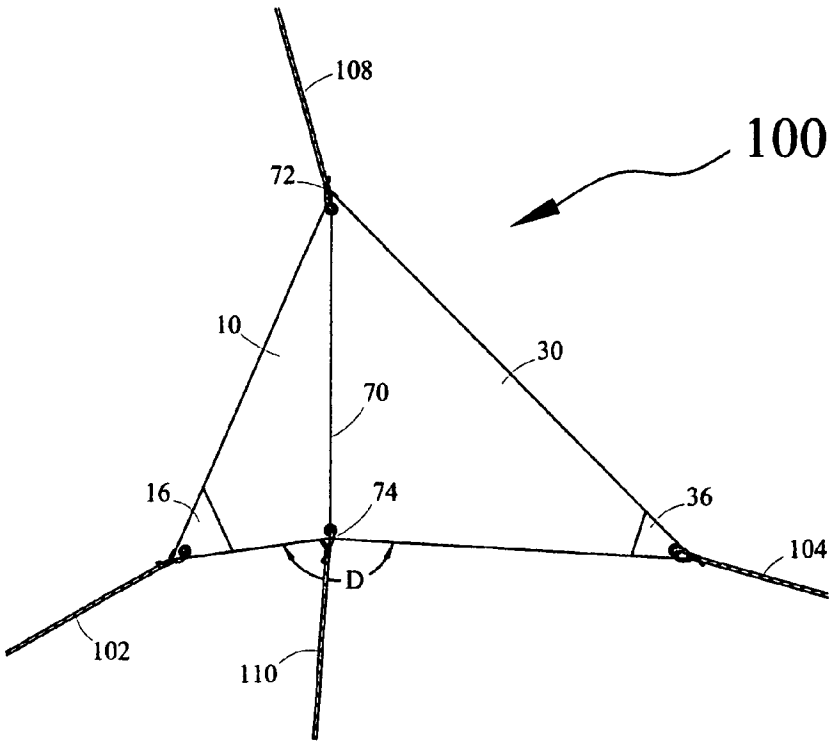
FIG. 4B is a two-dimensional view illustrating the angle between a spoiler 10 and a first wing 30 of the anchoring sail 100, according to an exemplary embodiment of the present invention.
Figure 4A:
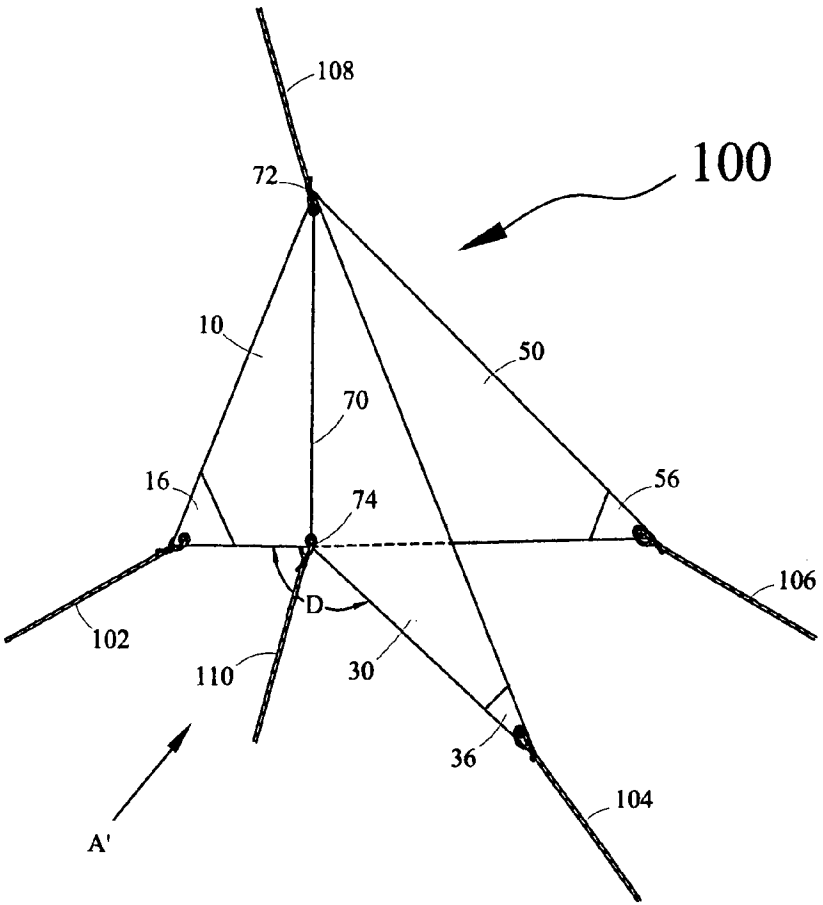
FIG. 4A is a perspective view of an anchoring sail 100 in the rigged state, according to an exemplary embodiment of the present invention.

As shown in FIG. 2, the anchoring sail 100 "floats" above the deck 210 of the sailboat 200 (i.e., floats above the upper surface of the sailboat 200). The anchoring sail 100 may fit on any sailboat, since it only requires universal structural components found on all sailboats, for example, a mast 220, a railing 230 disposed on the deck 210, a boom 240, and other structural components on the deck 210 of the sailboat 200 as engagement points. This makes it easy to manufacture and distribute, which is an important commercial advantage offered by the design of the anchoring sail 100.

For engagement with the different structural components of the sailboat 200, in one embodiment, the anchoring sail 100 further comprises a plurality of holes 82 and a plurality of grommets 84 fixed therein that removably engage with suitable fastening means for rigging the anchoring sail 100 on the sailboat 200. The grommets 84 prevent tearing of the spoiler 10, the first wing 30, and the second wing 50 when rigging the anchoring sail 100. Preferably, the holes 82 and the grommets 84 are disposed at bottom end portions 16, 36, 56 of the spoiler 10, the first wing 30, and the second wing 50, respectively; at the top end portion 72 of the common edge 70; and at the bottom end portion of 74 of the common edge 70.

In one embodiment, the fastening means are ropes fastened at one end to a structural component of the sailboat 200 and at the other end to a portion of the anchoring sail 100 through holes 82 and grommets 84 for fastening the spoiler 10, the first wing 30, and the second wing 50 to different portions of the sailboat 200. For example, the spoiler 10 may be fastened to a mast 220 of the sailboat 200 using a rope 102 tied at one end to an intermediate position 222 of the mast 220 and at the other end to the bottom end portion 16 of the spoiler 10, through the holes 82 and grommets 84; the first wing 30 may be fastened to a first position 232 on railing 230 or any other convenient structure on the deck 210, using a rope 104 tied at one end to the first position 232 on the railing 230 and at the other end to the bottom end portion 36 of the first wing 30, through the holes 82 and grommets 84; and, similarly, the second wing 50 may be fastened to a second position 234 on the railing 230 or any other convenient structure on the deck 210, using a rope 106 tied at one end to the second position 234 on the railing 230 and at the other end to the bottom end portion 56 of the second wing 50, through the holes 82 and grommets 84. Additionally, the top end portion 72 of the common edge 70 of the anchoring sail 100 may be fastened through a pulley arrangement 224 disposed at a top position 226 of the mast 220 using a halyard rope 108 to pull the anchoring sail 100 upwards, when required (See FIG. 2); and the bottom end portion 74 of the common edge 70 may be fastened to an intermediate position 242 of the boom 240, using a rope 110 tied at one end to the intermediate position 242 of the boom 240, and at the other end to the bottom end portion 74 of the common edge 70. Alternatively, a combination of ropes and piston hank arrangements may be used to fasten the anchoring sail 100 to the sailboat.

The fastening of the anchoring sail 100 to different structural components of the sailboat 200 is achieved in a manner such that the orientation of the spoiler 10, the first wing 30, and the second wing 50 with respect to each other results in a three-dimensional pyramidal-type structure with the spoiler 10 behaving as a leading edge for the two wings (i.e., the first wing 30 and the second wing 50) in a dihedral orientation. Such a structure results in a dihedral effect to keep the sailboat in line, i.e., in a normal position. When wind causes the sailboat 200 to swing away from the normal position, the sailboat 200 may sideslip, causing one wing facing the wind to offer more resistance than the other wing, thereby generating a lift and in turn the dihedral effect. Such a lift restores the sailboat 200 to the normal position. The spoiler 10 is capable of cutting off wind to one side of the anchoring sail 100, while channeling the wind to the other side of the anchoring sail 100, thereby developing a strong force vector on the windward side of the sailboat 200, and an equal reduction in force on the leeward (downwind) side of the sailboat 200. Due to this action of spoiler 10, a powerful correcting effect takes place within the first few degrees of the swing, before the swinging momentum of the sailboat 200 has developed. As a result, the action of the spoiler 10 counters the swinging of the sailboat 200 in an anchored or moored position with great efficiency. The rigging must be done in a manner such that the angle 'B' and angle 'C' are greater than or equal to about the angle 'A', thereby enabling proper functioning of the anchoring sail 100. Now, referring to FIGS. 4A and 4B, when in tension, i.e., the spoiler 10 fastened to the mast 220, the first wing 30 fastened to the railing 230 and the second wing 50 fastened to the railing 230, the angle 'D' between the bottom edge of the spoiler 10 and the bottom edge of the first wing 30 or an angle (not shown) between the bottom edge of the spoiler 10 and the bottom edge of the second wing 50 is less than 180 degrees, thereby stabilizing the dihedral three-dimensional pyramidal-type structure of the anchoring sail 100.

The spoiler 10, the first wing 30 and the second wing 50 are oriented in a manner such that the angle 'D' between the bottom edge of the spoiler 10 and the bottom edge of the first wing 30 and the angle between the bottom edge of the spoiler 10 and the bottom edge of the second wing 50 may be altered by changing the positions of the lines leading to the railing 230 and boom 240 of the sailboat 200 to create the most effective ratio of drag and sideways resistance for the conditions.

Additionally, the anchoring sail 100 comprises a notch (not shown) at the junction of the spoiler 10, the first wing 30, and the second wing 50 at the bottom of the anchoring sail 100, i.e., at the bottom end portion of 74 of the common edge 70. The notch together with the pyramidal structure of the anchoring sail 100, when deployed on the sailboat 200, provides stability and assures that the anchoring sail 100 holds its shape and perform its function even in strong winds without the need of any solid material reinforcements.

The anchoring sail 100 (i.e., the spoiler 10, the first wing 30, and the second wing 50) may be made up of a material providing remarkable tear strength, burst resistance, durability and shape-holding characteristics to the anchoring sail 100. Suitable materials include, but are not limited to, woven polymer fabrics with known stretch characteristics, and non-woven polymer fabrics (for example, extruded or co-extruded plastic sheets).

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is understood that various omissions, substitutions or equivalents are contemplated as circumstances may suggest or render expedient, but are intended to cover the application or implementation without departing from the spirit or scope of the claims of the present invention.

What is claimed is:

1. A spoiler anchoring sail for a sailboat, comprising:
a first wing;
a second wing attached to the first wing at a common edge;
a spoiler attached to the first wing and the second wing at the common edge;
the spoiler, the first wing and the second wing being oriented such that an angle between the spoiler and the first wing and an angle between the spoiler and the second wing are greater than or equal to about an angle between the first wing and the second wing; and
a plurality of fasteners for fastening the spoiler, the first wing and the second wing to spaced locations on the sailboat so that the angle between the first wing and the second wing can be adjusted.

2. The spoiler anchoring sail of claim 1, wherein the fasteners include a plurality of holes and a plurality of grommets fixed therein, the holes and the grommets being removably engageable with fastening means for fastening the anchoring sail to the sailboat.

3. The spoiler anchoring sail of claim 2, wherein the holes and the grommets are disposed at
bottom end portions of the spoiler, the first wing and the second wing; and
a top end portion and a bottom end portion of the common edge.

4. The spoiler anchoring sail of claim 3, wherein
the bottom end portion of the spoiler is fastenable to an intermediate position of a mast of the sailboat;
the bottom end portion of the first wing is fastenable to a first position on a railing of the sailboat;
the bottom end portion of the second wing is fastenable to a second position on the railing;
the top end portion of the common edge is fastenable to a top position of the mast; and
the bottom end portion of the common edge is fastenable to an intermediate position on a boom of the sailboat.

5. The spoiler anchoring sail of claim 2, wherein the fastening means are ropes, each rope having one end fastened to a portion of the spoiler anchoring sail and another end fastenable to a structural component of the sailboat.

6. The spoiler anchoring sail of claim 5, wherein the structural component is selected from the group consisting of a mast, a railing disposed on the sailboat, a boom, and combinations including at least one of the mast, the railing or the boom.

7. The spoiler anchoring sail of claim 1, wherein the spoiler is operable to cut off wind to one side of the spoiler anchoring sail, while channeling the wind to the other side of the spoiler anchoring sail, thereby developing a strong force vector on a windward side of the sailboat, and an equal reduction in force on a leeward side of the sailboat.

8. The spoiler anchoring sail of claim 1, wherein the spoiler, the first wing and the second wing are oriented relative to each other so as to cause a dihedral effect for enabling one wing among the first wing and the second wing to offer more resistance to wind than the other wing.

9. A dihedral anchoring sail for a sailboat, comprising:
a first wing;
a second wing attached to the first wing at a common edge;
a spoiler attached to the first wing and the second wing at the common edge; and
a plurality of holes and grommets disposed at
bottom end portions of the spoiler, the first wing and the second wing, and
a top end portion and a bottom end portion of the common edge, the holes and grommets being removably engageable with fastening means for fastening the dihedral anchoring sail to the sailboat;

the spoiler, the first wing and the second wing being oriented such that an angle between the spoiler and the first wing and an angle between the spoiler and the second wing are greater than or equal to about an angle between the first wing and the second wing; and the spoiler, the first wing and the second wing are oriented relative to each other so as to cause a dihedral effect for enabling one wing among the first wing and the second wing.

10. The dihedral anchoring sail of claim 9, wherein the fastening means are ropes, each rope having one end fastened to a portion of the dihedral anchoring sail and another end fastenable to a structural component of the sailboat.

11. The dihedral anchoring sail of claim 10, wherein the spoiler is fastenable to a mast of the sailboat using a rope having the one end fastened to the bottom end portion of the spoiler and the another end fastenable to an intermediate position of the mast.

12. The dihedral anchoring sail of claim 10, wherein the first wing is fastenable to a first position on a railing disposed on the sailboat using a first rope having the one end fastened to the bottom end portion of the first wing and the another end fastenable to the first position on the railing; and the second wing is fastenable to a second position on the railing using a second rope having the one end fastened to the bottom end portion of the second wing and the another end fastenable to the second position on the railing.

13. The dihedral anchoring sail of claim 10, wherein the top end portion of the common edge of the anchoring sail is fastenable to a mast of the sailboat through a pulley arrangement disposed at a top position of the mast using a halyard rope.

14. The dihedral anchoring sail of claim 10, wherein the bottom end portion of the common edge is fastenable to an intermediate position of a boom of the sailboat using a rope having the one end fastened to the bottom end portion of the common edge and the another end fastenable to the intermediate position of the boom.

15. The dihedral anchoring sail of claim 9, wherein the dihedral anchoring sail floats above a deck of the sailboat when in an assembled position on the sailboat.

16. The dihedral anchoring sail of claim 9, further comprising a notch at the bottom end portion of the common edge for stabilizing the dihedral anchoring sail when fastened to the sailboat.

17. A method of countering swinging of a sailboat in an anchored position using an anchoring sail, the method comprising:

pivoting a first wing of the anchoring sail to a first position on the sailboat;

pivoting a second wing of the anchoring sail to a second position on the sailboat, the second wing being attached to the first wing at a common edge;

pivoting a spoiler of the anchoring sail to an intermediate position on the sailboat, the spoiler being attached to the first wing and the second wing at the common edge; and fastening a top end portion of the common edge to a top of a mast of the sailboat;

the spoiler, the first wing and the second wing being oriented such that an angle between the spoiler and the first wing and an angle between the spoiler and the second wing are greater than or equal to about an angle between the first wing and the second wing, wherein the spoiler, the first wing and the second wing cause a dihedral effect for enabling one wing among the first wing and the second wing to offer greater resistance to wind than the other wing.

18. The method of claim 17, further comprising fastening a bottom end portion of the common edge to an intermediate position on a boom of the sailboat.

19. A spoiler anchoring sail mounted to a sailboat, the spoiler anchoring sail comprising:

a first wing;

a second wing attached to the first wing at a common edge; and a spoiler attached to the first wing and the second wing at the common edge;

the first wing, the second wing and the spoiler being fastened to structural components of the sailboat so that an angle between the spoiler and the first wing and an angle between the spoiler and the second wing are greater than or equal to an angle between the first wing and the second wing, and the angle between the first wing and the spoiler is adjustable.

20. The spoiler anchoring sail as claimed in claim 19, wherein the angle between the second wing and the spoiler is adjustable.

21. The spoiler anchoring sail as claimed in claim 19, wherein the common edge is substantially parallel to a mast of the sailboat.

22. A method of countering swinging of a sailboat in an anchored position using an anchoring sail, the method comprising:

fastening a first wing of the anchoring sail to a first position on the sailboat;

fastening a second wing of the anchoring sail to a second position on the sailboat, the second wing being attached to the first wing at a common edge;

fastening a spoiler of the anchoring sail to a third position on the sailboat intermediate the first and second positions, the spoiler being attached to the first wing and the second wing at the common edge; and fastening a top end portion of the common edge to a fourth position on the sailboat, the fourth position being above the first, second and third positions;

the spoiler, the first wing and the second wing being oriented so that an angle between the spoiler and the first wing and an angle between the spoiler and the second wing are greater than or equal to an angle between the first wing and the second wing, wherein the spoiler, the first wing and the second wing are oriented so that one of the first wing and the second wing offers greater resistance to wind than the other of the first wing and the second wing.

* * * * *

UNITED STATES PATENT AND TRADEMARK OFFICE

CERTIFICATE OF CORRECTION

PATENT NO. : 7,406,922 B2
APPLICATION NO. : 11/499562
DATED : August 5, 2008
INVENTOR(S) : Jess Gregory It is certified that error appears in the above-identified patent and that said Letters Patent is hereby corrected as shown below:

Column 2, line 4, "causes" should read --cause--.
Column 2, line 34, "causes" should read --cause--.
Column 7, line 11, after "wing" insert --to offer greater resistance to wind than the other wing--.

Signed and Sealed this

Sixth Day of October, 2009

David J. Kappos

David J. Kappos
*Director of the United States Patent and Trademark Office*